United States Patent [19]

Dibrell

[11] Patent Number: 4,484,511

[45] Date of Patent: Nov. 27, 1984

[54] PISTON

[75] Inventor: Edwin W. Dibrell, San Antonio, Tex.

[73] Assignee: Centrifugal Piston Expanders, Inc., San Antonio, Tex.

[21] Appl. No.: 450,651

[22] Filed: Dec. 17, 1982

Related U.S. Application Data

[62] Division of Ser. No. 443,901, Nov. 23, 1982.

[51] Int. Cl.³ ..... F01C 9/00; F16J 1/00

[52] U.S. Cl. ..... 92/67; 92/65; 92/120; 92/172; 92/255

[58] Field of Search ..... 92/120, 177, 172, 67, 92/178, 255, 65

[56] References Cited

U.S. PATENT DOCUMENTS

| | | | |
|---|---|---|---|
| 303,602 | 8/1884 | Dieckmann | 92/255 |
| 2,251,259 | 8/1941 | Carmichael | 92/178 |
| 2,463,486 | 3/1949 | Johnson | 92/172 |
| 2,996,049 | 8/1961 | Huska | 92/120 |
| 3,716,310 | 2/1973 | Guenther | 92/172 |
| 3,995,536 | 12/1976 | Tenfjord | 92/120 |
| 4,246,833 | 1/1981 | Burklund | 92/172 |

*Primary Examiner*—Paul E. Maslousky

*Attorney, Agent, or Firm*—Norvell & Associates

[57] ABSTRACT

A piston for a fluid pressure chamber having an arcuate longitudinal axis. Such piston comprises an assemblage of two spherical bodies in side-by-side relationship and interconnected by a universal pivot. Each spherical body carries a circumferential piston ring receiving groove and piston rings are mounted in such grooves to provide a sliding and sealable engagement with the walls of the fluid pressure chamber as the piston moves along the curved longitudinal axis of such chamber.

4 Claims, 1 Drawing Figure

PISTON

RELATIONSHIP TO OTHER CO-PENDING APPLICATIONS

This application constitutes a division of application Ser. No. 443,901, filed Nov. 23, 1982, and assigned to the Assignees of this application.

BACKGROUND OF THE INVENTION

1. Field of the Invention

The invention relates to a piston for slidable and sealable cooperation with a fluid pressure chamber, and particularly a fluid pressure chamber having an arcuate longitudinal axis.

2. Description of the Prior Art

A piston is conventionally thought of as a cylindrical member having one or more peripheral grooves formed thereon and each groove mounting a piston ring. The rings slidably and sealably cooperate with the cylindrical bore of a cylinder. In the above referred to patent application, and additionally in my co-pending applications, Ser. Nos. 436,412 and 436,852, both filed Oct. 25, 1982, and assigned to the Assignees of this application, there is disclosed an apparatus for extracting heat and/or mechanical energy from a pressured gas wherein a plurality of cylinders are employed defining fluid pressure chambers having arcuate longitudinal axes. Obviously, for a piston to slidably and sealably cooperate with the walls of such a pressure chamber, the ordinary cylindrically shaped piston would not be effective.

It has previously been proposed, for example in Siddons et al. U.S. Pat. No. 3,648,670, to employ a ball or sphere as the piston element in a cylinder having an S-shaped configuration. The employment of a ball does not provide a substantial sealing action between the piston and the wall of the fluid pressure chamber due to the fact that essentially only point contacts are provided between the periphery of the ball and the internal bore of the longitudinally curved fluid pressure chamber. It would obviously be desirable to incorporate a piston ring on a spherical shaped piston in order to improve its sealability, but heretofore no means have been suggested for maintaining such piston ring in proper alignment with the walls of an arcuate axis fluid pressure chamber.

SUMMARY OF THE INVENTION

This invention provides an improved piston for slidably and sealably cooperating with the walls of a fluid pressure chamber having an arcuate longitudinal axis. More specifically, the piston embodying this invention employs at least two spherical shaped bodies which are interconnected in side-by-side relationship by a universal pivot, such as a ball joint. Additionally, each of the balls making up the new piston is provided with a piston ring groove and a piston ring is inserted in such groove and is maintained in proper alignment with the walls of the fluid pressure chamber due to the pivotal interconnection of the two spherical bodies.

Further objects and advantages of the invention will be readily apparent to those skilled in the art from the following detailed description, taken in conjunction with the annexed drawing on which is shown a preferred embodiment of the invention.

BRIEF DESCRIPTION OF THE DRAWING

The single FIGURE on the drawing represents a sectional view of a piston embodying this invention shown in operative relationship within a fluid pressure chamber having an arcuate longitudinal axis.

DESCRIPTION OF THE PREFERRED EMBODIMENT

Figure 1:
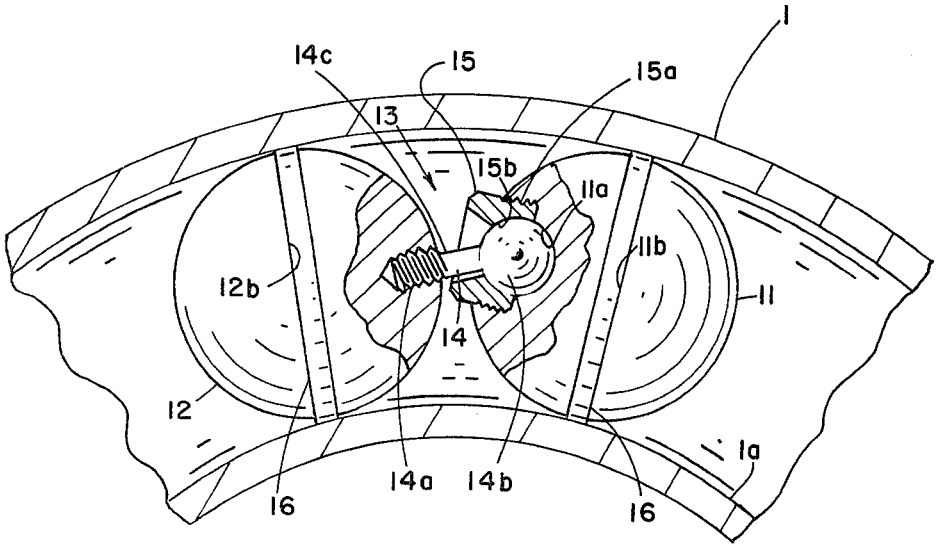

A fluid pressure chamber of the type utilized in the above-identified co-pending applications is represented by the cylinder 1 having an internal bore surface 1*a* which has an arcuate longitudinal axis. The piston 10 embodying this invention comprises two spherical bodies 11 and 12 which are respectively universally pivotally interconnected in side-by-side relationship by a ball joint connection 13.

The ball joint connection 13 comprises a bolt-like member 14 having an end 14*a* threadably engaged with one of the spherical bodies, for example the body 12. The head end 14*b* of the bolt member 14 has spherical segment shape and cooperates with a correspondingly shaped internal socket surface 11*a* formed in the spherical body 11. The bolt head 14*a* is secured in the socket 11*a* by a sleeve 15 which is slidable over the shank portion 14*c* of bolt 14 and has external threads 15*a* engageable with internal threads provided in the spherical body 11 around the outer portion of the socket 11*a*. The inner surface 15*b* of sleeve 15*a* is shaped as a spherical segment surface so as to retain the spherically shaped head portion 14*b* of the bolt 14 in engagement with the spherical body 11, but permits free, but limited pivoting movement in all planes of the spherical body 11 with respect to head portion 14*b*, hence providing a universal pivotal connection between spherical bodies 11 and 12.

Additionally, each spherical body 11 and 12 is provided with a circumferential piston ring receiving groove 11*b* and 12*b*. These grooves are normally, prior to the spherical bodies being inserted in an arcuate fluid pressure chamber, parallel to each other and perpendicular to a line interconnecting the centers of the spherical bodies 11 and 12 when such bodies are disposed in their extended or radially aligned positions relative to each other, such as when both spherical bodies are displaced the maximum distance from each other permitted by the universal pivotal connection. Piston rings 16 are respectively mounted in the piston ring receiving grooves 11*b* and 12*b* and slidingly and sealingly cooperate with the internal bore surface 1*a* of the arcuate fluid pressure chamber.

Those skilled in the art will recognize that the employment of two interconnected spherical balls as piston elements will effectively reduce the fluid leakage around such pistons by one half, even without the provision of any rings on such pistons. With the provision of the piston rings 16, the fluid leakage is reduced to a much larger extent. In this connection, it should be noted that the extent of pivotal movement of the one ball 11 with respect to the other ball 12 should be limited to that which will still permit the piston ring 16 to resiliently expand and maintain their respective engagement with the internal bore surface 1*a*. This factor may require the piston 16 to be of greater radial depth than normally employed on a conventional cylindrical piston. Also, more than two such spheres may be universally pivotally interconnected if the length of the fluid pressure chamber permits the piston to be constructed with such increased overall length.

It is therefore apparent that upon the application of fluid pressure differential across the piston 10, the piston will readily move through the arcuate fluid pressure chamber and, due to the fact that two piston rings are provided, each of which are in intimate contact with the bore surface 1*a* of the fluid pressure chamber, will minimize gas leakage across the piston and thus efficiently transmit the gaseous energy to the piston.

Although the invention has been described in terms of specified embodiments which are set forth in detail, it should be understood that this is by illustration only and that the invention is not necessarily limited thereto, since alternative embodiments will become apparent to those skilled in the art in view of the disclosure. Accordingly, modifications are contemplated which can be made without departing from the spirit of the described invention.

What is claimed is:

1. A piston for use in an arcuate fluid pressure chamber having an arcuate longitudinal axis comprising a pair of generally spherical bodies and universal pivot means interconnecting said spherical bodies in side-by-side relationship to permit relative angular displacement of said spherical bodies as they conjointly move through said arcuate fluid pressure chamber.

2. A piston in accordance with claim 1 wherein each said spherical body has a circumferential piston ring groove formed therein, said grooves being normally parallel and respectively perpendicularly disposed relative to a line interconnecting the centers of said spherical bodies when said bodies are disposed relative to each other with the maximum separation permitted by said universal pivot means; and a piston ring mounted in each said piston ring groove.

3. A piston in accordance with claim 1 wherein said universal pivot means comprises a spherical segment socket formed in one of said spherical bodies; a bolt secured in a radial position in said other spherical body, said bolt having a spherical segment head cooperable with said spherical segment socket; and means for securing said spherical segment bolt head within said spherical segment socket.

4. A piston in accordance with claim 2 wherein said universal pivot means comprises a spherical segment socket formed in one of said spherical bodies; a bolt secured in a radial position in said other spherical body, said bolt having a spherical segment head cooperable with said spherical segment socket; and means for securing said spherical segment bolt head within said spherical segment socket.

* * * * *